US007951097B2

(12) United States Patent
Schaeffer

(10) Patent No.: US 7,951,097 B2
(45) Date of Patent: May 31, 2011

(54) AUTOMATED THERAPY TABLE FOR TREATING LOWER EXTREMITIES AND METHOD THEREFOR

(76) Inventor: Dwight L. Schaeffer, Tempe, AZ (US)

( * ) Notice: Subject to any disclaimer, the term of this patent is extended or adjusted under 35 U.S.C. 154(b) by 0 days.

(21) Appl. No.: 12/752,950

(22) Filed: Apr. 1, 2010

(65) Prior Publication Data

US 2010/0313897 A1 Dec. 16, 2010

Related U.S. Application Data

(60) Provisional application No. 61/187,168, filed on Jun. 15, 2009.

(51) Int. Cl.
*A61H 1/00* (2006.01)

(52) U.S. Cl. ..... 601/5; 601/23; 601/24; 601/27; 601/34

(58) Field of Classification Search ..... 601/5, 23, 601/24, 26–35, 49, 86, 87, 90, 93, 98, 101; 602/32, 33, 36; 606/237, 240, 241, 243; 128/845

See application file for complete search history.

(56) References Cited

U.S. PATENT DOCUMENTS

| | | | | |
|---|---|---|---|---|
| 5,050,589 | A * | 9/1991 | Engle | 601/26 |
| 5,207,216 | A * | 5/1993 | Sweeny | 601/5 |
| 5,376,060 | A * | 12/1994 | Murray | 601/33 |
| 6,692,451 | B2 * | 2/2004 | Splane, Jr. | 601/5 |
| 6,821,288 | B2 * | 11/2004 | Schaeffer | 606/240 |
| 2005/0256538 | A1 * | 11/2005 | Cuccia | 606/241 |

* cited by examiner

*Primary Examiner* — Quang D Thanh
(74) *Attorney, Agent, or Firm* — Veronica-Adele R. Cao; Weiss & Moy, P.C.

(57) ABSTRACT

An automated therapy table is disclosed. The automated therapy table may have various support portions capable of independent automatic actuation of a person's lower extremities through passive exercise. The automated therapy table allows a patient to perform leg elevation, approximation/decompression of the leg, internal/external rotation of the leg, ankle plantar flexion/dorsiflexion, and foot inversion/eversion movements. During each movement, the patient may be instructed to think in the direction of the movement. It has been found that doing so helps increase the healing effects. The disclosed table and method may be beneficial for patients after certain operations as well as for those suffering from various forms of debilitating illnesses, such as Multiple Sclerosis, Charcot-Marie-Tooth, and Muscular Dystrophy.

16 Claims, 5 Drawing Sheets

AUTOMATED THERAPY TABLE FOR TREATING LOWER EXTREMITIES AND METHOD THEREFOR

CROSS REFERENCE TO RELATED APPLICATIONS

This application claims priority to a corresponding provisional application U.S. Ser. No. 61/187,168, filed Jun. 15, 2009 in the name of the Applicant, which is incorporated herein by reference. This application is also related to U.S. Pat. No. 6,821,288, which was issued on Nov. 23, 2004 in the name of the Applicant and which is also incorporated herein by reference.

FIELD OF THE INVENTION

This invention relates generally to therapy tables, and more specifically, to an automated therapy table having various support portions capable of independent automatic actuation of a person's lower extremities through passive exercise by performing leg elevation, approximation/decompression of the leg, internal/external rotation of the leg, ankle plantar flexion/dorsiflexion, and foot inversion/eversion.

BACKGROUND OF THE INVENTION

Over 2.5 million people worldwide suffer from Multiple Sclerosis (MS) and over a quarter of a million children and adults suffer from some form of joint contracture. Joint contracture is a stiffening of the muscles near the joints that can make it difficult for individuals to move. In some cases, this leads to joints locking in a painful position.

Physical therapy, especially regular stretching, is important in helping to enhance the range of motion for affected muscles and to prevent or delay contractures. Physical therapy can also help maintain muscle tone and reduce the severity of joint contractures. With regular exercise, muscles are kept strong and joints more flexible. It is believed that strengthening supporting muscle groups to compensate for weakened muscle groups might be beneficial to patients with early stages of Muscular Dystrophy (MD).

People with various forms of debilitating illnesses, such as Multiple Sclerosis (MS), Charcot-Marie-Tooth (CMT), and Muscular Dystrophy (MD) suffer from progressive weakness, pain, and degeneration of skeletal muscles that are required for voluntary movement. For treatment, these people often seek the assistance of a physical therapist, chiropractor, or other medical practitioner in order to alleviate their discomfort. A physical therapist will often resort to stretching techniques to ease a patient's discomfort—positioning the patient on a therapy table and manually stretching and manipulating the patient's body. This can be physically demanding for the therapist. The lower extremities are especially difficult to manipulate because of their length, size, and weight.

A need therefore existed for an automated therapy table which may be controlled by a physical therapist or other medical practitioner to actuate various component portions of the table in order to move parts of a person's body, specifically the lower extremities, in a desired direction for a desired period of time without causing physical stress to the physical therapist or medical practitioner. All of the functions of the automated therapy table, accompanied by the thought process of the patient assisting in the direction of every movement, help to rehabilitate and strengthen muscles.

SUMMARY OF THE INVENTION

In accordance with one embodiment of the present invention, a therapy table is disclosed. The therapy table comprises at least one torso platform for supporting a torso of a person, and an exercise platform coupled to the torso platform, the exercise platform for exercising at least one of a leg and a foot of the person in a desired range of motion.

In accordance with another embodiment of the present invention, a therapy table is disclosed. The therapy table comprises a base, a torso platform coupled to the base for supporting a torso of a person, and at least one exercise platform coupled to the torso platform, the exercise platform for exercising at least one of a leg and a foot of the person in at least one of leg elevation, leg approximation, leg decompression, medial leg rotation, lateral leg rotation, ankle plantar flexion, ankle dorsiflexion, foot inversion, and foot eversion.

In accordance with another embodiment of the present invention a method for treating the lower extremities of a person is disclosed. The method comprises the steps of providing a therapy table comprising a torso platform for supporting a torso of a person; at least one exercise platform coupled to the torso platform, the exercise platform for exercising at least one of a leg and a foot of the person in at least one of leg elevation, leg approximation, leg decompression, medial leg rotation, lateral leg rotation, ankle plantar flexion, ankle dorsiflexion, foot inversion, and foot eversion; and thinking by the person of a particular movement while performing one of leg elevation, leg approximation, leg decompression, medial leg rotation, lateral leg rotation, ankle plantar flexion, ankle dorsiflexion, foot inversion, and foot eversion.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
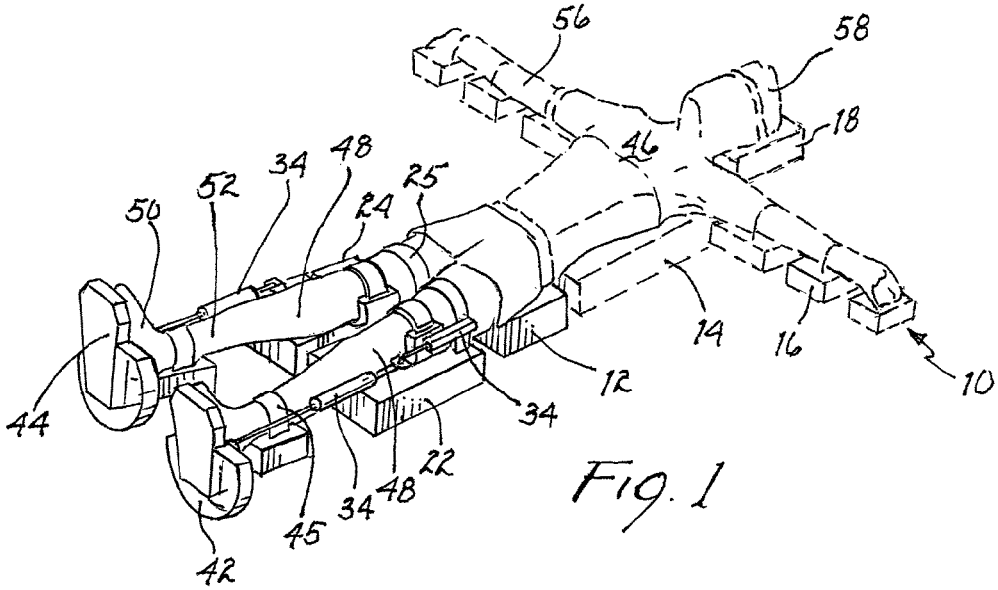
FIG. 1 is a perspective view of one embodiment of an automated therapy table for treating lower extremities in accordance with the present invention.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

Referring to FIGS. 1-14, an automated therapy table for treating lower extremities, hereinafter automated therapy table 10, is shown. The automated therapy table 10 is dimensioned to support a person 46 in a supine position and to assist the person 46 in performing passive controlled movements such as: leg elevation, approximation/decompression of the leg 48, internal/external rotation of the leg 48, ankle plantar flexion/dorsiflexion, and foot inversion/eversion. In its simplest form, the therapy table 10 comprises a torso platform 20 for supporting the torso of the person 46 and an exercise platform 21 to assist the person 46 in any one or any combination of the aforementioned exercises.

Referring to FIG. 1, the automated therapy table 10 may have a base 11, a lumbar platform 12, a thoracic platform 14, two arm platforms 16, and a head support 18. It should also be clearly understood that substantial benefit may be derived from the automated therapy table 10 having one whole upper body platform to support the person's torso, head 58, and arms 56 or from the automated therapy table 10 having certain platforms combined to form one piece (e.g. the thoracic platform 14 and the lumbar platform 12 may be combined together to form a torso platform 20).

The automated therapy table 10 is shown as having two leg platforms 22 and two foot plates 44 movably coupled to an inferior end of the torso platform 20. While each leg platform 22 could comprise a single section capable of medial/lateral or posterior/anterior movement, it is preferred that each leg platform 22 be multi-sectioned in a manner corresponding to the leg 48 and ankle 52 joints.

Figure 2:
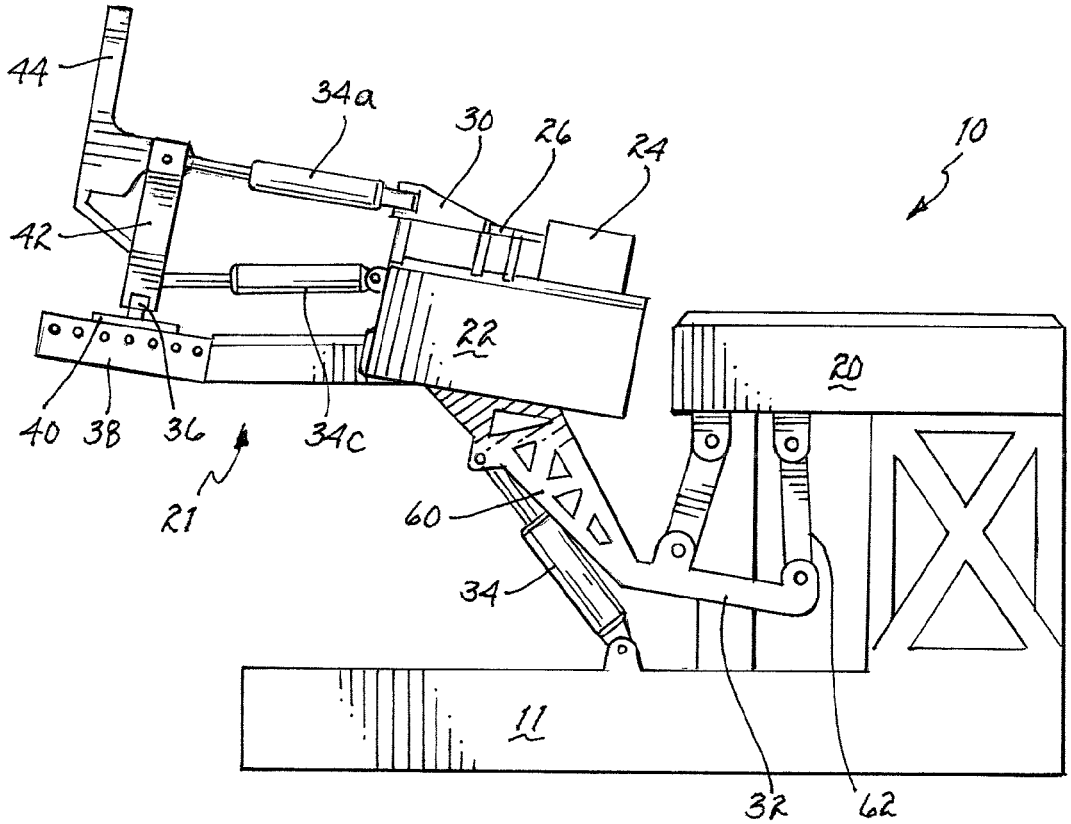
FIG. 2 is a side view of the automated therapy table of FIG. 1, shown performing the movement of leg elevation.

FIG. 2 shows the automated therapy table 10 performing the passive movement of leg elevation. Leg elevation helps relieve lower leg swelling, which is commonly known as leg edema. Leg edema is typically caused by abnormal accumulation of fluid in the tissues of the lower extremity. Usually, individuals who sit for long periods of time, experience leg tightness or leg edema. To prevent this, individuals who are bed-ridden or lack mobility should elevate their legs as often as they can to loosen tight muscles. Leg elevation is also beneficial in returning blood to the body, which can improve leg circulation.

In order for the therapy table 10 to be able to assist a person 46 in the performance of this movement, the exercise platform 21 may have a leg platform 22 hingedly coupled to the torso platform 20 with a hinge assembly 32. In one embodiment, the therapy table 10 will have a support member 60 coupled to a bottom surface of the leg platform 22. A pivot arm 62 may have one end pivotably coupled to a distal end of the support member 60 of the leg platform 22 and may have another end pivotably coupled to a bottom surface of the torso platform 20. There may also be an actuator 34 having one end that is pivotably coupled to a proximal end of the support member 60 of the leg platform 22 and another end that is pivotably coupled to the base 11 of the therapy table 10. When the actuator 34 extends, the leg platform 22 is raised and when the actuator 34 retracts, the leg platform 22 is lowered back to a resting position. While it is shown in the figure that the hinge assembly 32 has two pivot arms 62, it should be clearly understood that substantial benefit may be achieved from a single pivot arm 62 or more than two pivot arms 62.

Figure 4:
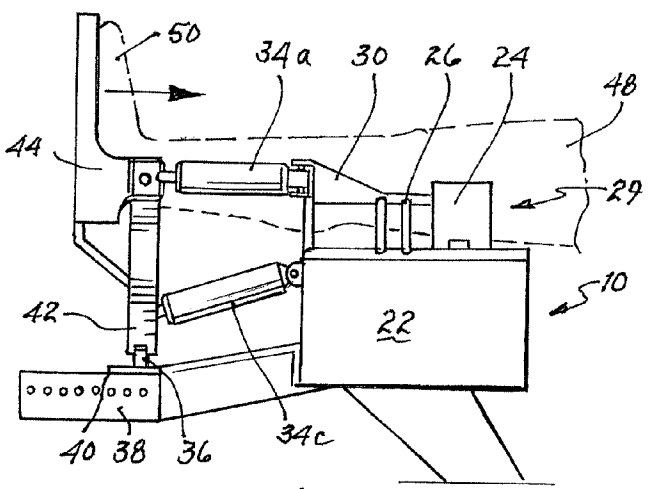
FIG. 4 is a side view of the automated therapy table of FIG. 1, shown performing the movement of leg decompression.
Figure 3:
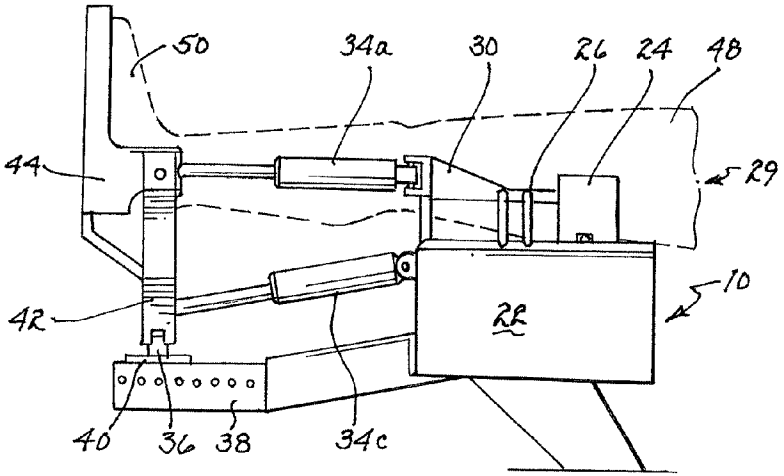
FIG. 3 is a side view of the automated therapy table of FIG. 1, shown performing the movement of leg approximation.

FIGS. 3 and 4 show the automated therapy table 10 performing the passive movements of approximation (see FIG. 3) and decompression (see FIG. 4) of the leg 48. Leg approximation/decompression help relieve joint pain caused by compression and flexion. Joint pain can be alleviated by decreasing pressure on the joint and by increasing blood flow by eliminating metabolic waste, which can reduce inflammation and numbness in the leg. Decompression is a safe and natural alternative to surgery, injections or prescription medication. One of the primary benefits of approximation is to simulate weight bearing to maintain/increase bone density in individuals who lack mobility.

In order for the therapy table 10 to be able to assist a person 46 in this type of movement, the exercise platform 11 may have a leg platform 22 for supporting the leg 48 of the person 46, a foot housing 42 coupled to the leg platform 22 for supporting the foot 50 of the person 46, and at least one actuator 34. The actuator 34 may have one end coupled to the foot housing 42 and may have another end coupled to the leg platform 22. When the actuator 34 extends, the foot housing 42 moves in an inferior direction, and thus allows the leg 48 to move inferiorly along a frontal plane (leg approximation). When the actuator 34 retracts, the foot housing 42 moves in a superior direction, and thus allows the leg 48 to move superiorly along a frontal plane (leg decompression).

To further assist in this movement, the exercise platform 11 may also have a roller assembly 35. The roller assembly 35 may comprise a roller block housing 38 (see FIG. 14) coupled to the distal end of the leg platform 22 and at least one roller 37 within the roller block housing 38. A roller block 40 may be coupled to the roller 37 within the roller block housing 38 and a bi-directional roller 36 may be coupled to the roller block 40. At least two rows of wheels 39 may be coupled to a distal end of the bi-directional roller 36 and at least two corresponding tracks 41 may be present in the bottom surface of the foot housing 42; each track 41 would be dimensioned to receive a row of wheels 39. The roller assembly 35 would assist the movement of the foot housing 42 in an inferior and superior direction as the rollers 37 move within the roller block housing 38.

Figure 6:
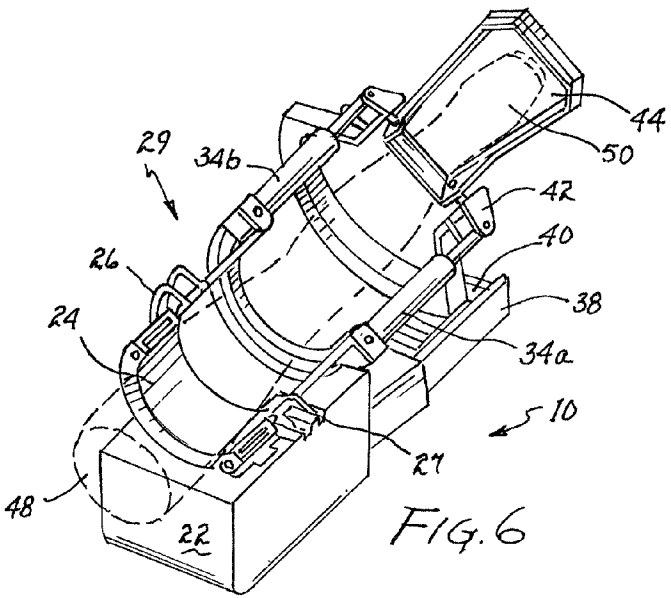
FIG. 6 is a perspective view of the automated therapy table of FIG. 1, shown performing the movement of external leg rotation.
Figure 5:
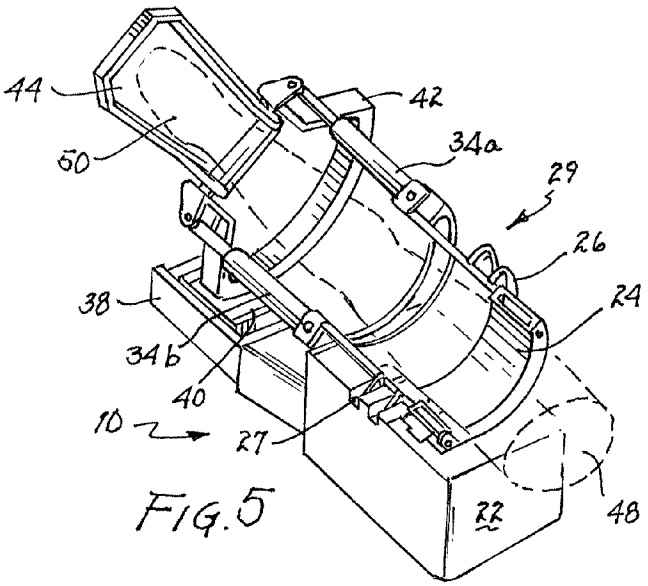
FIG. 5 is a perspective view of the automated therapy table of FIG. 1, shown performing the movement of internal leg rotation.

FIGS. 5 and 6 show the automated therapy table 10 performing the passive movements of internal or medial (see FIG. 5) and external or lateral (see FIG. 6) leg rotation. These movements help strengthen and stabilize the respective rotators of the hip. Over time, the piriformis muscle tightens from the lack of immobility and use. It is believed that internal and external leg rotations improve a person's motional disability by preventing external torsion of the tibia. The exercise platform 21 of the therapy table 10 may assist these movements if it has a leg platform 22 for supporting the leg 48 of the person 46 and a rotation assembly 29. The rotation assembly 29 may have a leg restraint 24 (such as a clamp 25 or strap) coupled to the leg platform 22 for securing the leg 48 in place. There may be a plurality of teeth 64 coupled to a bottom portion of the leg restraint 24 and a gear mechanism 28 coupled to the leg platform 22 that also has teeth that mesh with the teeth 64 of the leg restraint 24. When the gear mechanism 28 is rotated, it causes the leg restraint 24 to rotate the leg 48 either medially or laterally. The roller assembly 35 may also assist the movement of the foot housing 42 in lateral rotation and medial rotation when the wheels 39 move along the tracks 41 of the foot housing 42. Furthermore, the exercise platform 21 may also have at least one rail 26 coupled to the bottom portion of the leg restraint 24 and at least one channel 27 formed within a top surface of the leg platform 22 that receives the rail 26. Together, the rails 26 moving within the channels 27 help to guide the rotation of the leg restraint 24 within the leg platform 22.

Figure 8:
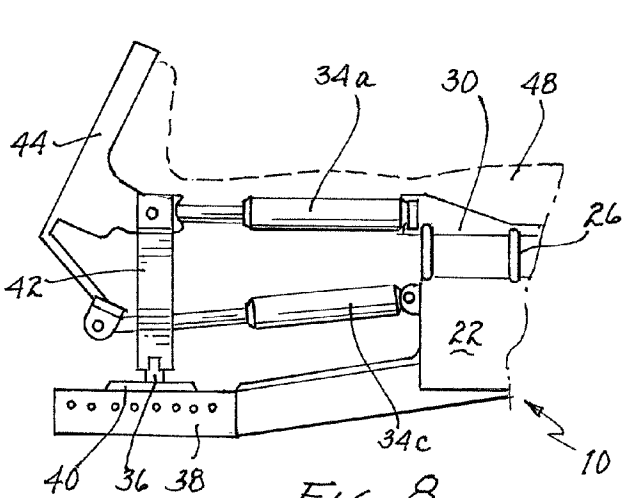
FIG. 8 is a side view of the automated therapy table of FIG. 1, shown performing the movement of ankle dorsiflexion.
Figure 7:
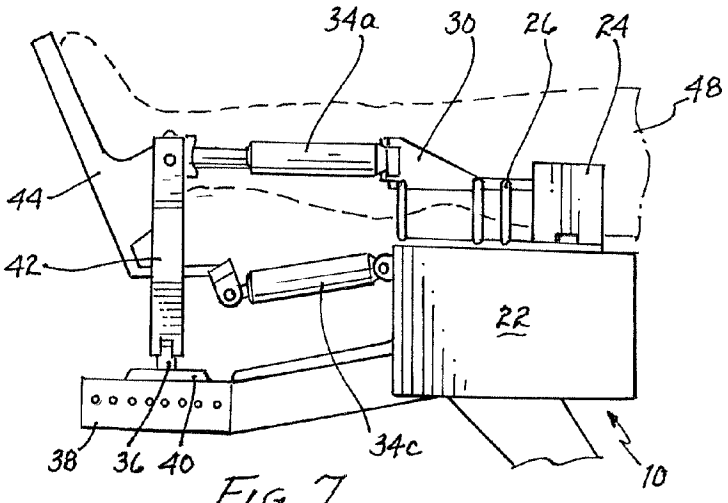
FIG. 7 is a side view of the automated therapy table of FIG. 1, shown performing the movement of ankle plantar flexion.

FIGS. 7 and 8 show the automated therapy table 10 performing the passive movements of ankle plantar flexion (see FIG. 7) and ankle dorsiflexion (see FIG. 8). These movements treat and help prevent lower extremity disorders associated with injury, illness or immobility, including ankle contractures. Since the ankle 52 controls the movement of the leg 48 relative to the foot 50 and is, therefore, subjected to the weight of the entire body and the forces generated by the dissipation of kinetic energy when the foot 50 makes contact with the ground, it has been determined that articulation of the ankle 52 through plantar flexion and dorsiflexion is paramount to relieving joint stiffness, inflammation, and providing increased range of motion.

In order to assist with these movements the exercise platform 21 may have a leg platform 22 for supporting the leg 48 of the person 46, a foot housing 42 coupled to the leg platform 22 for supporting the foot 50, a foot plate 44 pivotably coupled to the foot housing 42, and at least two actuators 34. One actuator 34 may be a superior actuator 34 having one end coupled to the leg platform 22 and having another end coupled to an anterior portion of the foot housing 38. The other actuator 34 may be an inferior actuator 34 having one end coupled to the leg platform 22 and having another end coupled to a posterior portion of the foot housing 38. When the superior actuator 34 extends, it causes the anterior portion of the foot housing 38 to move, thereby allowing foot plantar flexion. When the inferior actuator 34 extends, it causes the posterior portion of the foot housing 38 to move, thereby allowing foot dorsiflexion.

Figure 10:
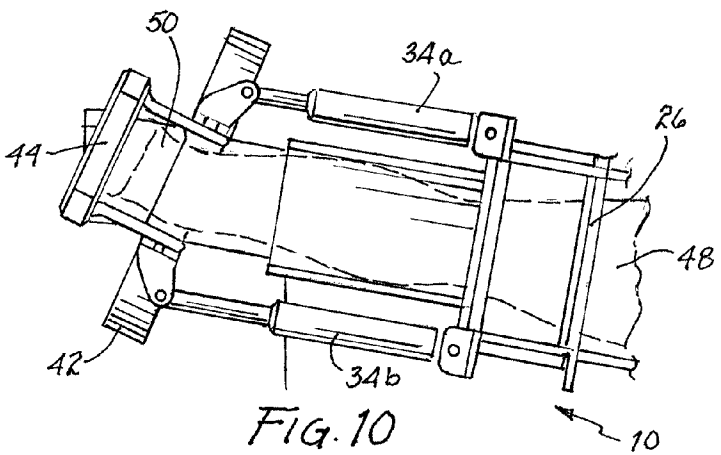
FIG. 10 is a top view of the automated therapy table of FIG. 1, shown performing the movement of foot eversion.
Figure 9:
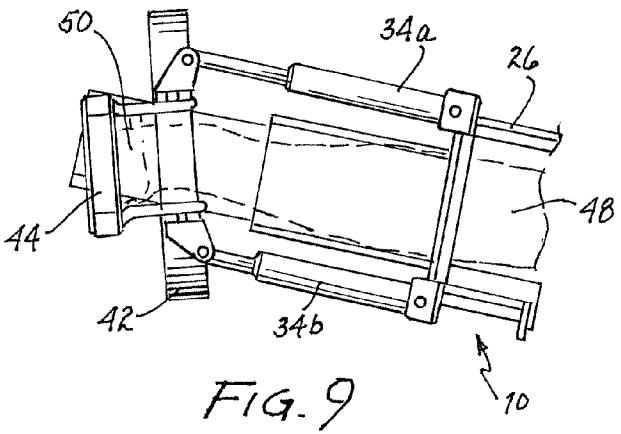
FIG. 9 is a top view of the automated therapy table of FIG. 1, shown performing the movement of foot inversion.

FIGS. 9 and 10 show the automated therapy table 10 performing the passive movements of foot inversion (see FIG. 9) and eversion (see FIG. 10). These are movements in which the sole of the foot 50 is made to face inward and outward, respectively. Foot inversion and eversion help eliminate metabolic waste and strengthens the calves and shins.

In order to assist these movements, the exercise platform 21 may have a leg platform 22, a foot housing 42 coupled to the leg platform 22, a foot plate 44 pivotably coupled to the foot housing 42, and four actuators 34. A lateral superior actuator 34*a* may have one end coupled to a lateral portion of the leg platform 22 and may have another end coupled to a lateral anterior portion of the foot housing 42 and a medial superior actuator 34*b* may have one end coupled to a medial portion of the leg platform 22 and may have another end coupled to a medial anterior portion of the foot housing 42. A lateral inferior actuator 34*c* may have one end coupled to the lateral portion of the leg platform and may have another end coupled to a lateral posterior portion of the foot housing 42 and a medial inferior actuator 34*d* may have one end coupled to the medial portion of the leg platform 22 and may have another end coupled to a medial posterior portion of the foot housing 42. When the lateral superior actuator 34*a* and the lateral inferior actuator 34*c* extend, this allows for the movement of foot inversion. When the medial superior actuator 34*b* and the medial inferior actuator 34*d*, this allows for the movement of foot eversion.

Figure 11:
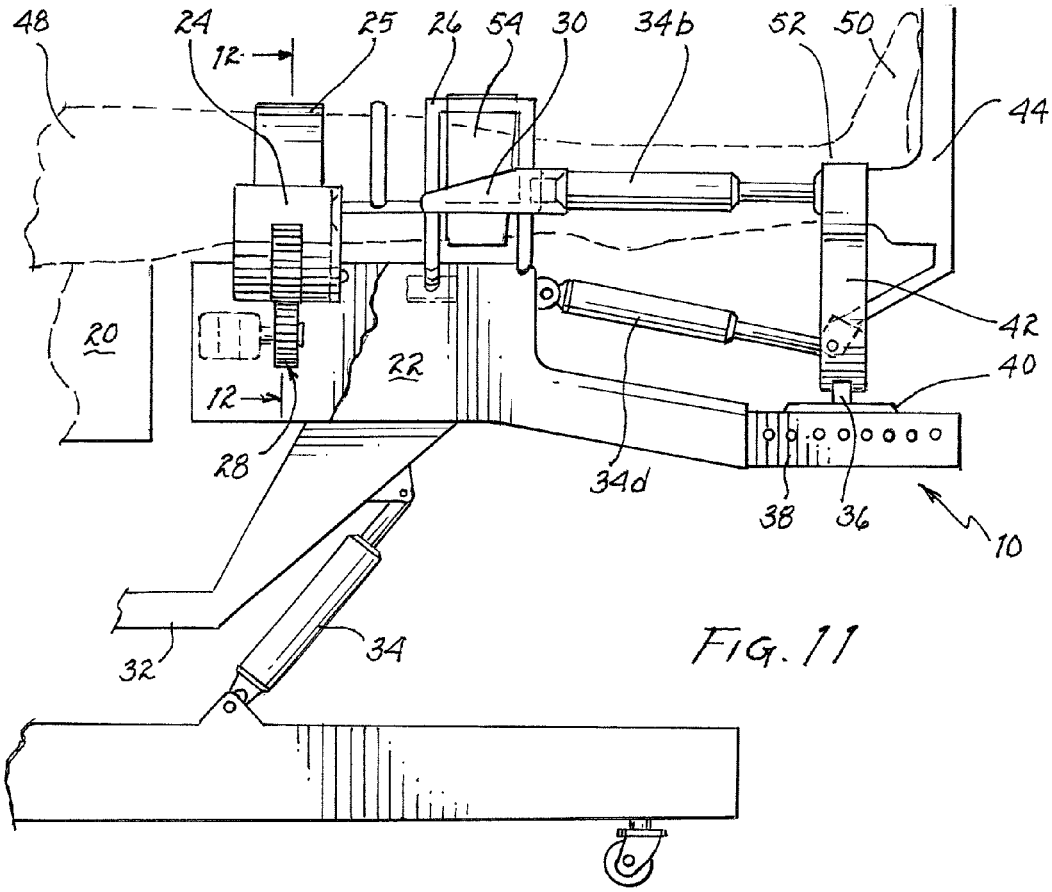
FIG. 11 is a side view of the automated therapy table of FIG. 1.

FIG. 11 shows the automated therapy table 10 in an at rest position. In one embodiment, the therapy table 10 may be used to perform all of the following movements: leg elevation, leg approximation, leg decompression, medial leg rotation, lateral leg rotation, ankle plantar flexion, ankle dorsiflexion, foot inversion, and foot eversion. In order to do so, the therapy table 10 may have a base 11, a torso platform 20 coupled to the base 11, a leg platform 22, a support member 60 coupled to and extending downwardly from a bottom surface of the leg platform 22, a roller assembly 35 coupled to a distal end of the leg platform 22, a foot housing 42 coupled to the roller assembly 35 for supporting the foot 50 of the person 46, a foot plate 44 pivotably coupled to the foot housing 42, a hinge assembly 32 that pivotably couples the leg platform 22 to the torso platform 20, an actuator 34 having one end pivotably coupled to a proximal end of the support member 60 and having another end pivotably coupled to the base 11 of the therapy table 10. The table 10 may also have a plurality of actuators 34, each actuator 34 having one end coupled to the leg platform 22 and having another end coupled to the foot housing 42 as well as a leg rotation assembly 29 coupled to the leg platform 22.

The leg platform 22 may be movably coupled to an inferior end of the torso platform 20 by the hinge assembly 32. An actuator 34 or drive mechanism raises and lowers the leg platform 22 along a sagittal plane during leg elevation movements (see FIG. 2). The actuator 34 is coupled at one end to the leg platform 22 and the other end is either coupled to the base 11 or rests on the floor.

Figure 12:
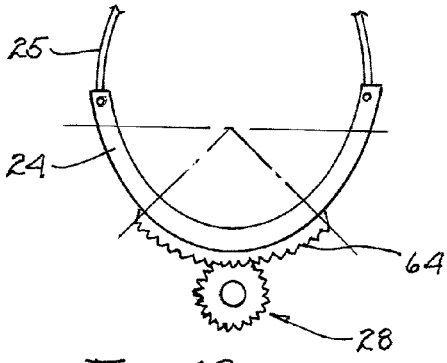
FIG. 12 is a side view of a gear mechanism and femur support portion of a clamp of the automated therapy table of FIG. 1.
Figure 13:
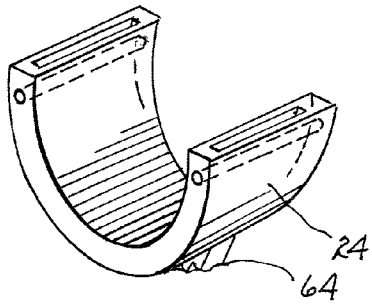
FIG. 13 is a perspective view of the femur support of the automated therapy table of FIG. 1.

As shown in FIGS. 12 and 13, each leg platform 22 may have a leg restraint 24, e.g. a hinged clamp 25 and/or straps to hold the patient's leg 48 in place. A system of rails 26 and gears 28 also may be used to allow internal and external leg rotation (see FIGS. 5 and 6), moving the leg 48 along a transverse plane. The leg platform 22 may have channels 27 to receive the rails 26. These channels 27 and rails 26 may help to guide the leg restraint 24 as it rotates within the leg platform 22. The clamp 25, rails 26, and gears 28 are shown positioned proximate the patient's 46 knee 54 joint.

Figure 14:
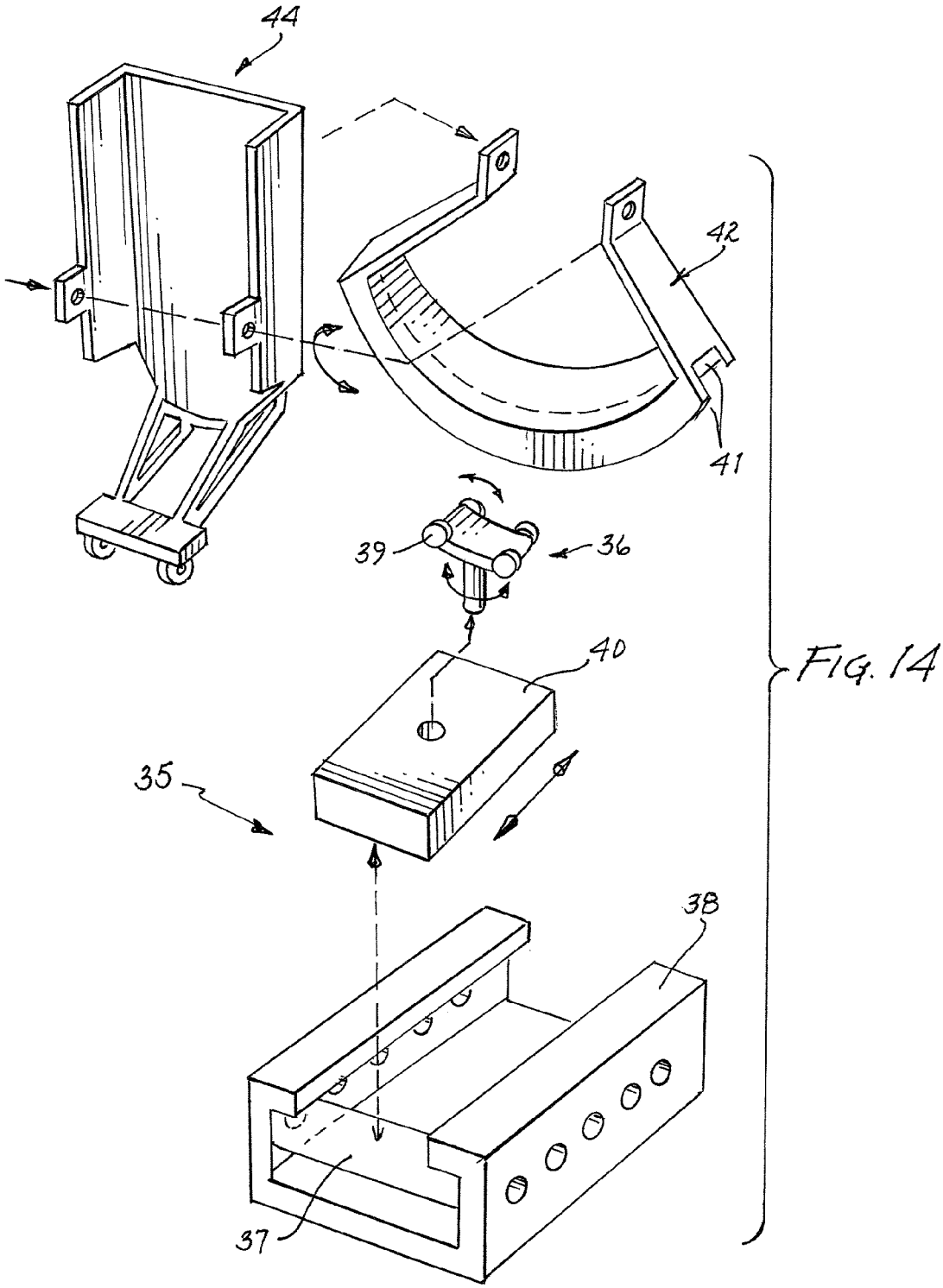
FIG. 14 is an exploded view of a roller assembly and foot housing which may be used with the present invention.

As shown in FIG. 14, the leg platform 22 may also have a foot housing 42 where a patient's 46 foot 50 will rest and a foot plate 44 that is movably coupled to the foot housing 42. In one embodiment, the foot housing 42 may be coupled to a bidirectional roller 36, the bidirectional roller 36 may then be coupled to a roller block 40, and the roller block 40 may be slidably coupled to a roller block housing 38. The roller block 40 moves along a sagittal plane as the rollers 37 move within the roller block housing 38, allowing for the ankle plantar flexion/dorsiflexion movements and for foot inversion/eversion movements. This design would also accommodate for the difference in the lengths of patients' 46 legs 48. The bidirectional roller 36 also allows the foot 50 to move along a transverse plane, allowing for the foot inversion/eversion movements. The foot housing 42 may also have a hinged clamp and/or strap to hold the patient's 46 foot 50 in place.

There may be a pair of actuators 34 or drive mechanisms on each of the lateral side and the medial side of each leg platform 22. There may be one lateral superior actuator 34*a*, one medial superior actuator 34*b*, one lateral inferior actuator 34*c*, and one medial inferior actuator 34*d* may be used to move the foot housing 42 in relation to the leg platform 22. The superior actuators 34*a*/34*b* may be located directly lateral and medial to the patient's 46 legs 48. An alignment enclosure 30 may be used to keep the superior actuators 34*a*/34*b* straight. If all four actuators 34*a*/34*b*/34*c*/34*d* extend at the same time, then the automated therapy table 10 will assist the movement of leg approximation (see FIG. 3), wherein the leg movement occurs along a frontal plane. If all four actuators 34*a*/34*b*/34*c*/34*d* retract at the same time, then the automated therapy table 10 will assist the movement of leg decompression (see FIG. 4), which also occurs along the frontal plane.

If the superior actuators 34*a*/34*b* extend and the inferior actuators 34*c*/34*d* contract or remain stationary, then the automated therapy table 10 will assist the movement of ankle plantar flexion (see FIG. 7), wherein the foot 50 moves along the sagittal plane. And if the superior actuators 34*a*/34*b* contract or remain stationary and the inferior actuators 34*c*/34*d* extend, then the automated therapy table 10 will assist the movement of ankle dorsiflexion (see FIG. 8), the foot 50 also moving along the sagittal plane. Furthermore, if the medial actuators 34*b*/34*d* contract or remain stationary and the lateral actuators 34*a*/34*c* extend, then the automated therapy table 10 will assist the movement of foot inversion (see FIG. 9), wherein the foot 50 moves along the transverse plane. And finally, if the medial actuators 34*b*/34*d* extend and the lateral actuators 34*a*/34*c* contract or remain stationary, then the automated therapy table 10 will assist the movement of foot eversion (see FIG. 10), the foot 50 also moving along the transverse plane.

It is preferred that the patient 46 internalize or think about each movement while performing the movement. As an example, when the patient 46 performs the movement of decompression, the patient 46 may think "long" or "lengthening" as he/she performs the movement. This type of communicative balancing amplifies the benefit of the movement and is a valuable aspect of the method because it will help to maintain long-term effects from use of the automated therapy table 10.

In a preferred embodiment, the automated therapy table 10 is pneumatically driven. However, it should be clearly understood that substantial benefit could be derived from an alternative configuration of the automated therapy table 10 in which other automated means for adjusting the component portions and supports is used, such as hydraulic, electric or perhaps even lever-type means.

This apparatus and process makes the job of the therapist significantly less difficult and less physically demanding. Thus, instead of the therapist being required to bend over the automated therapy table 10, grasp a portion of the patient's 46 leg 48, and physically move the patient's 46 leg 48 in the desired direction for the required period of time—the therapist can select the desired portion of the patient's 46 leg 48, the desired direction of movement, and activate the appropriate actuators 34. The actuators 34 will then move the appropriate part of the patient's 46 leg 48 in the proper direction, and the part of the patient's 46 leg 48 will be held there until the therapist determines that sufficient time has passed to make it appropriate to release the part of the patient's 46 leg 48. While it is generally contemplated that the therapist will activate the actuators 34, it would be possible for the patient to do so as well.

STATEMENT OF USE

It is preferred that a world trained technician, physical therapist, or other health professional operate the automated therapy table 10 of the present invention. It should also be clearly understood that substantial benefit may be derived from the patient being able to operate the automated therapy table 10 himself/herself.

Prior to receiving any treatment, the patient 46 will ideally undergo a physical assessment to determine the existence of any contraindications. If there are any, then certain modifications may be made to the usual movements.

For the movements of leg elevation, internal/external leg rotation, ankle plantar flexion/dorsiflexion, and foot inversion/eversion, the movement will be held for several seconds. Preferably, these movements will be held for less than ten seconds each. For the weight bearing movement of approximation (or compression), the movement may be held for longer than ten seconds. During each movement, the patient 46 will preferably be instructed to think in the direction of the movement. It has been found that doing so helps increase the healing effects. For example, during the movement of foot inversion, the patient 46 will think that his/her foot is moving inwardly toward the midsagittal plane of the body while his/her foot is actually moving inwardly toward the midsagittal plane of the body. As another example, during the movement of leg decompression, the patient 46 will think that about the lengthening of his/her hip muscle(s). Thinking in the direction of the movement is recommended for every movement of the automated therapy table 10, except the weight bearing movement of leg approximation.

The patient 46 may alternate movement of each of the lower extremities or the movements may be performed synergistically. Arm movement may also be performed in combination with the leg movements. For example, the patient's 46 arms 56 may be raised above the patient's head 58 and decompressed along the same plane (sagittal plane) as the patient's 46 legs 48. And preferably, the patient 46 will be thinking about stretching his/her arms 56 and legs 48.

All of the movements described herein help to treat myofascial abnormalities. Myofascia is a thin film that wraps around muscle tissue. It wraps around the muscle fibers individually as well as the muscles themselves and also forms the tendons and ligaments which connect the muscles to other parts of the body. A great deal of pain can result when the myofascia of a person becomes tight or thick. Fibromyalgia syndrome (FMS) is an example of a condition wherein the lack of myofascial flexibility is present. When the myofascia loses its elasticity, the efficiency of neurotransmitters, which communicate messages between the brain and the rest of the body, are impaired. Among other symptoms, physical pain usually results from myofascial abnormalities. All of the movements disclosed herein will help to create myofascial release.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A therapy table comprising:

at least one torso platform for supporting a torso of a person; and an exercise platform coupled to the torso platform, the exercise platform for exercising at least one of a leg and a foot of the person in a desired range of motion;

wherein the exercise platform comprises:

a leg platform for supporting the leg of the person;

a hinge assembly that pivotably couples the leg platform to the torso platform; and an actuator coupled to the leg platform for raising and lowering the leg-platform;

wherein the hinge assembly comprises:

a support member coupled to a bottom surface of the leg platform;

at least one pivot arm having one end pivotably coupled to a distal end of the support member of the leg platform and having another end pivotably coupled to a bottom surface of the torso platform;

wherein one end of the actuator is pivotably coupled to a proximal end of the support member of the leg platform; and wherein another end of the actuator is pivotably coupled to a base of the therapy table;

wherein extension of the actuator raises the leg platform and retraction of the actuator lowers the leg platform; and wherein the leg is raised and lowered along a sagittal plane.

2. A therapy table comprising:

at least one torso platform for supporting a torso of a person; and an exercise platform coupled to the torso platform, the exercise platform for exercising at least one of a leg and a foot of the person in a desired range of motion;

wherein the exercise platform comprises:

a leg platform for supporting the leg of the person;

a foot housing coupled to the leg platform for supporting the foot;

at least one actuator having one end coupled to the foot housing and having another end coupled to the leg platform;

wherein extension of the actuator allows the leg to move inferiorly along a frontal plane; and wherein retraction of the actuator allows the leg to move superiorly along a frontal plane.

3. A therapy table comprising:

at least one torso platform for supporting a torso of a person; and an exercise platform coupled to the torso platform, the exercise platform for exercising at least one of a leg and a foot of the person in a desired range of motion;

wherein the exercise platform comprises:

a leg platform for supporting the leg of the person;

a foot housing coupled to the leg platform for supporting a foot; and a roller assembly coupled to a distal end of the leg platform and coupled to a proximal end of the foot housing.

4. The therapy table of claim 3 wherein the roller assembly comprises:

a roller block housing coupled to the distal end of the leg platform;

at least one roller within the roller block housing;

a roller block coupled to the at least one roller within the roller block housing;

a bi-directional roller coupled to the roller block;

at least two rows of wheels coupled to a distal end of the bi-directional roller; and at least two tracks in the bottom surface of the foot housing, each track for receiving a row of the wheels;

wherein the roller assembly assists the movement of the foot housing in an inferior and superior direction as the rollers move within the roller block housing; and wherein the roller assembly assists the movement of the foot housing in lateral rotation and medial rotation when the wheels move along the tracks of the foot housing.

5. A therapy table comprising:

at least one torso platform for supporting a torso of a person; and an exercise platform coupled to the torso platform, the exercise platform for exercising at least one of a leg and a foot of the person in a desired range of motion;

wherein the exercise platform comprises:

a leg platform for supporting the leg of the person; and a rotation assembly comprising:

a leg restraint coupled to the leg platform for securing the leg in place;

a plurality of teeth coupled to a bottom portion of the leg restraint; and a gear mechanism coupled to the leg platform and having teeth that mesh with the teeth of the leg restraint;

wherein rotation of the gear mechanism causes the leg restraint to rotate the leg at least one of medially and laterally.

6. The therapy table of claim 5 further comprising:

at least one rail coupled to the bottom portion of the leg restraint; and at least one channel formed within a top surface of the leg platform that receives the rail for guiding the rotation of the leg restraint within the leg platform.

7. A therapy table comprising:

at least one torso platform for supporting a torso of a person; and an exercise platform coupled to the torso platform, the exercise platform for exercising at least one of a leg and a foot of the person in a desired range of motion;

wherein the exercise platform comprises:

a leg platform for supporting the leg of the person;

a foot housing coupled to the leg platform for supporting the foot;

a foot plate pivotably coupled to the foot housing;

at least one superior actuator having one end coupled to the leg platform and having another end coupled to an anterior portion of the foot housing; and at least one inferior actuator having one end coupled to the leg platform and having another end coupled to a posterior portion of the foot housing;

wherein extension of the superior actuator allows foot plantar flexion; and wherein extension of the inferior actuator allows foot dorsiflexion.

8. A therapy table comprising:

at least one torso platform for supporting a torso of a person; and an exercise platform coupled to the torso platform, the exercise platform for exercising at least one of a leg and a foot of the person in a desired range of motion;

wherein the exercise platform comprises:

a leg platform for supporting the leg of the person;

a foot housing coupled to the leg platform for supporting the foot;

a foot plate pivotably coupled to the foot housing;

a lateral superior actuator having one end coupled to a lateral portion of the leg platform and having another end coupled to a lateral anterior portion of the foot housing;

a medial superior actuator having one end coupled to a medial portion of the leg platform and having another end coupled to a medial anterior portion of the foot housing;

a lateral inferior actuator having one end coupled to the lateral portion of the leg platform and having another end coupled to a lateral posterior portion of the foot housing; and a medial inferior actuator having one end coupled to the medial portion of the leg platform and having another end coupled to a medial posterior portion of the foot housing;

wherein extension of the lateral superior actuator and the lateral inferior actuator allows foot inversion; and wherein extension of the medial superior actuator and the medial inferior actuator allow foot eversion.

9. A therapy table comprising:

a base;

a torso platform coupled to the base for supporting a torso of a person; and at least one exercise platform coupled to the torso platform, the exercise platform for exercising at least one of a leg and a foot of the person in at least one of leg elevation, leg approximation, leg decompression, medial leg rotation, lateral leg rotation, ankle plantar flexion, ankle dorsiflexion, foot inversion, and foot eversion;

wherein the exercise platform comprises:

a leg platform for supporting the leg of the person;

a support member coupled to and extending downwardly from a bottom surface of the leg platform;

a roller assembly coupled to a distal end of the leg platform;

a foot housing coupled to the roller assembly for supporting the foot of the person;

a foot plate pivotably coupled to the foot housing;

a hinge assembly that pivotably couples the leg platform to the torso platform;

an actuator having one end pivotably coupled to a proximal end of the support member and having another end pivotably coupled to the base of the therapy table;

a plurality of actuators, each actuator having one end coupled to the leg platform and having another end coupled to the foot housing; and a leg rotation assembly coupled to the leg platform.

10. The therapy table of claim 9 wherein the hinge assembly comprises at least one pivot arm having one end pivotably coupled to a distal end of the support member of the leg platform and having another end pivotably coupled to a bottom surface of the torso platform.

11. The therapy table of claim 9 wherein the plurality of actuators comprises:

a lateral superior actuator having one end coupled to a lateral portion of the leg platform and having another end coupled to a lateral anterior portion of the foot plate;

a medial superior actuator having one end coupled to a medial portion of the leg platform and having another end coupled to a medial anterior portion of the foot plate;

a lateral inferior actuator having one end coupled to the lateral portion of the leg platform and having another end coupled to a lateral posterior portion of the foot plate; and a medial inferior actuator having one end coupled to the medial portion of the leg platform and having another end coupled to a medial posterior portion of the foot plate.

12. The therapy table, of claim 11 further comprising:

a lateral alignment enclosure coupled to the leg platform and coupled to a proximal end of the lateral superior actuator for keeping the lateral superior actuator straight during extension and retraction; and a medial alignment enclosure coupled to the leg platform and coupled to a proximal end of the medial superior actuator for keeping the medial superior actuator straight during extension and retraction.

13. The therapy table of claim 9 wherein the leg rotation assembly comprises:

a leg restraint coupled to the leg platform for securing the leg in place;

a plurality of teeth coupled to a bottom portion of the leg restraint; and a gear mechanism coupled to the leg platform and having teeth that mesh with the teeth of the leg restraint;

wherein rotation of the gear mechanism causes the leg restraint to rotate the leg at least one of medially and laterally.

14. The therapy table of claim 13 wherein the leg rotation assembly further comprises:

at least one rail coupled to the bottom portion of the leg restraint; and at least one channel formed within a top surface of the leg platform that receives the rail for guiding the rotation of the leg restraint within the leg platform.

15. The therapy table of claim 9 further comprising at least two alignment enclosures coupled to leg platform for keeping the actuators straight during extension and retraction.

16. A method for treating lower extremities of a person comprising the steps of:

providing a therapy table comprising:

a torso platform for supporting a torso of a person; and at least one exercise platform coupled to the torso platform, the exercise platform for exercising at least one of a leg and a foot of the person in at least one of leg elevation, leg approximation, leg decompression, medial leg rotation, lateral leg rotation, ankle plantar flexion, ankle dorsiflexion, foot inversion, and foot eversion;

wherein the exercise platform comprises:

a leg platform for supporting the leg of the person;

a base;

a support member coupled to and extending downwardly from a bottom surface of the leg platform;

a roller assembly coupled to a distal end of the leg platform;

a foot housing coupled to the roller assembly for supporting the foot of the person;

a foot plate pivotably coupled to the foot housing;

a hinge assembly that pivotably couples the leg platform to the torso platform;

an actuator having one end pivotably coupled to a proximal end of the support member and having another end pivotably coupled to the base of the therapy table;

a plurality of actuators, each actuator having one end coupled to the leg platform and having another end coupled to the foot housing; and a leg rotation assembly coupled to the leg platform; and thinking by the person of a particular movement while performing one of leg elevation, leg approximation, leg decompression, medial leg rotation, lateral leg rotation, ankle plantar flexion, ankle dorsiflexion, foot inversion, and foot eversion.

* * * * *